US009568182B2

(12) United States Patent
Juarez

(10) Patent No.: US 9,568,182 B2
(45) Date of Patent: Feb. 14, 2017

(54) PURSE LIGHTING DEVICE

(71) Applicant: Michael A. Juarez, San Diego, CA (US)

(72) Inventor: Michael A. Juarez, San Diego, CA (US)

( * ) Notice: Subject to any disclaimer, the term of this patent is extended or adjusted under 35 U.S.C. 154(b) by 212 days.

(21) Appl. No.: 14/464,083

(22) Filed: Aug. 20, 2014

(65) Prior Publication Data

US 2016/0053986 A1 Feb. 25, 2016

(51) Int. Cl.

| | |
|---|---|
| ***F21V 33/00*** | (2006.01) |
| ***F21L 4/02*** | (2006.01) |
| ***A45C 3/06*** | (2006.01) |
| ***A45C 15/06*** | (2006.01) |
| *F21Y 101/00* | (2016.01) |

(52) U.S. Cl.

CPC ..... *F21V 33/0004* (2013.01); *A45C 3/06* (2013.01); *A45C 15/06* (2013.01); *F21L 4/02* (2013.01); *F21Y 2101/00* (2013.01)

(58) Field of Classification Search

None

See application file for complete search history.

(56) References Cited

U.S. PATENT DOCUMENTS 5,457,613 A * 10/1995 Vandenbelt ..... F21L 4/005 362/200
5,927,846 A 7/1999 Sinclair
6,070,990 A * 6/2000 Dalton ..... F21L 4/027 235/487
6,502,951 B2 1/2003 Marshall
6,533,436 B2 * 3/2003 Krietzman ..... E05B 17/103 362/183
6,769,618 B1 * 8/2004 Finkelstein ..... G02B 3/08 235/487
6,817,532 B2 * 11/2004 Finkelstein ..... G02B 3/08 235/380
7,015,654 B1 * 3/2006 Kuhlmann ..... H02M 3/156 315/291
7,111,959 B2 9/2006 Kurcz et al.
7,553,043 B2 6/2009 Venn
7,896,250 B2 * 3/2011 Waters ..... G02B 25/008 235/487
8,277,073 B2 10/2012 Wells
2003/0090898 A1 * 5/2003 Goldstein ..... F21L 4/00 362/200
2006/0060656 A1 * 3/2006 Waters ..... F21L 4/027 235/487
2006/0077058 A1 * 4/2006 Asher ..... G08B 21/24 340/568.7
2008/0198585 A1 8/2008 Tait
(Continued)

*Primary Examiner* — Britt D Hanley
(74) *Attorney, Agent, or Firm* — Dale J. Ream

(57) ABSTRACT

A purse security device according to the present invention includes a front panel having a front side and a back side opposite the front side, the front panel having a generally planar configuration. The purse security device includes a back panel having a front side and a back side opposite the front side, the back panel having a generally planar configuration. The back side of the front panel is operably coupled to the front side of the back panel. A circuit board having a battery is positioned on the front side of the back panel. A light element is situated on the front side of the front panel and electrically connected to the battery and selectively energized thereby. The back side of the back panel is selectively coupled to an inner wall of a purse for illuminating an interior area of the purse.

14 Claims, 8 Drawing Sheets

(56) References Cited

U.S. PATENT DOCUMENTS

| | | | | |
|---|---|---|---|---|
| 2009/0196026 | A1 | 8/2009 | Finke et al. | |
| 2012/0318780 | A1* | 12/2012 | Juarez | H05B 3/26 219/209 |
| 2015/0022099 | A1* | 1/2015 | Farley | H05B 33/0857 315/161 |
| 2015/0327647 | A1* | 11/2015 | Wiklacz | A45C 15/06 362/156 |
| 2016/0084492 | A1* | 3/2016 | Voskanian | F21V 33/0004 362/555 |
| 2016/0153645 | A1* | 6/2016 | Leuty | F21V 23/04 362/184 |

* cited by examiner

PURSE LIGHTING DEVICE

BACKGROUND OF THE INVENTION

The present invention relates generally to lighting devices and, more particularly, to a lighting device specially configured to illuminate an interior area of a purse.

It is often difficult for a woman to find items within her purse in that purses are often deep and become the repository for numerous relatively small items, such as keys, cell phones, other electronic devices, pens, wallet, checkbook, makeup, and the like. The task of finding a desired item is made even more difficult after the sun has set or in a darkened room. In these environments, a person must use only her sense of touch to search for an item unless or until a light can be switched on.

Various lighting devices are known in the art that are capable of lighting a purse, such as a flashlight, pressure activated glow sticks, and the like. Although assumably effective for their intended uses, the existing devices are just as likely to become lost in the purse as the very items they are intended to locate.

Therefore, it would be desirable to have a purse lighting device that selectively illuminates an interior area of a purse. Further, it would be desirable to have a purse lighting device that may be positioned on an inner wall of the purse so as to provide illumination to substantially all of the interior area. In addition, it would be desirable to have a purse lighting device that is thin, does not obstruct usage, and does not appear to be a lighting device until energized.

SUMMARY OF THE INVENTION

A purse security device according to the present invention includes a front panel having a front side and a back side opposite the front side, the front panel having a generally planar configuration. The purse security device includes a back panel having a front side and a back side opposite the front side, the back panel having a generally planar configuration. The back side of the front panel is operably coupled to the front side of the back panel. A circuit board having a battery is positioned on the front side of the back panel. A light element is situated on the front side of the front panel and electrically connected to the battery and selectively energized thereby. The back side of the back panel is selectively coupled to an inner wall of a purse for illuminating an interior area of the purse.

Therefore, a general object of this invention is to provide a purse lighting device configured to selectively illuminate an interior area of a purse.

Another object of this invention is to provide a purse lighting device, as aforesaid, that is configured to attach to an inner wall of the purse adjacent the area to be illuminated.

Still another object of this invention is to provide a purse lighting device, as aforesaid, that is thin, does not obstruct usage, and is not revealed as being a lighting device until it is energized.

Yet another object of this invention is to provide a purse lighting device, as aforesaid, that is optionally removable for use outside of the purse.

A still further object of this invention is to provide a purse lighting device, as aforesaid, that is easy and user-friendly to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
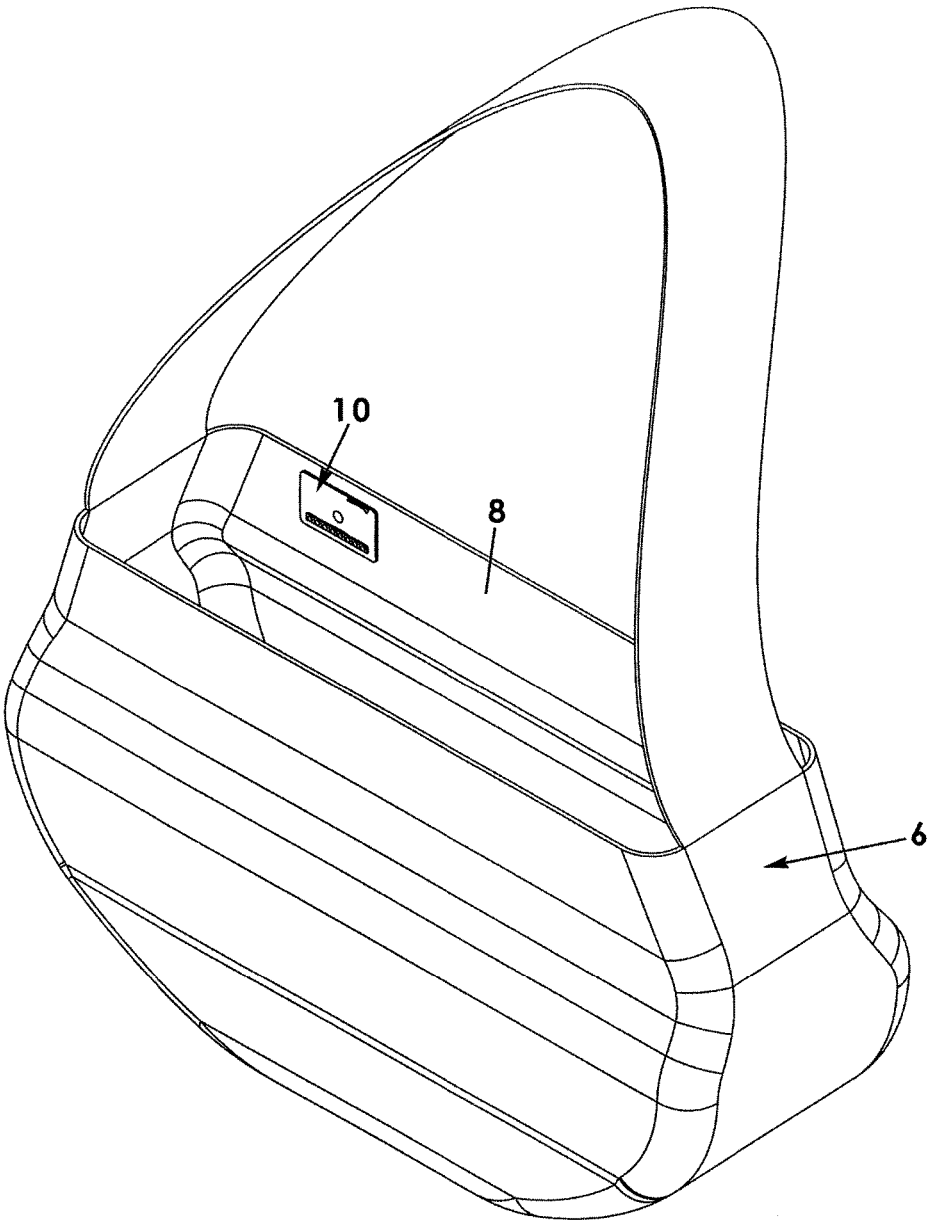
FIG. 1*a* is a perspective view of a purse lighting device according to one embodiment of the present invention illustrated being coupled to a purse in a retracted configuration.

A purse lighting device according to a preferred embodiment of the present invention will now be described with reference to FIGS. 1 to 6*b* of the accompanying drawings. The purse lighting device 10 includes a front panel 20, a back panel 30, a battery 28, and a lighting element 36 for use with a purse 6 having an inner wall 8 that defines an interior area.

The front panel 20 includes a front side 22 and a back side 24 opposite the front side 22. Preferably, the front panel 20 includes a generally planar configuration having a thin width. Similarly, the back panel 30 includes a front side 32 and a back side 34 opposite the front side 32. Preferably, the back panel 30 includes a generally planar configuration having a thin width. The back side 24 of the front panel 20 is operably coupled to the front side 32 of the back panel 30 such that the purse lighting device 10 is presented in the general shape of a credit card.

In an embodiment, the front side 32 of the back panel 30 includes a circuit board 26 (FIG. 3) having circuitry configured to operate a lighting element when energized as will be described in more detail later. Preferably, the battery 28 is electrically connected to the circuit board 26 (FIG. 3) and configured to transfer current to the circuit board 26 when actuated to do so.

Figure 3:
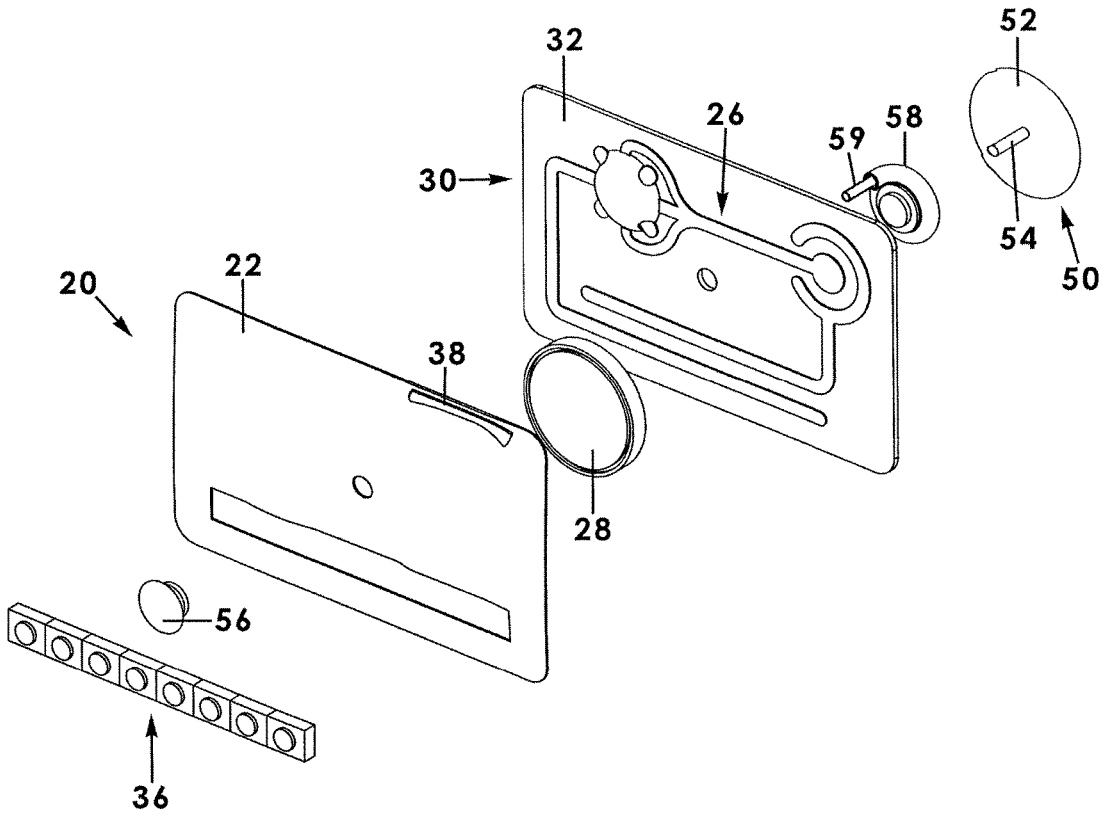
FIG. 3 is an exploded view of the purse lighting device as in FIG. 3.
Figure 4:
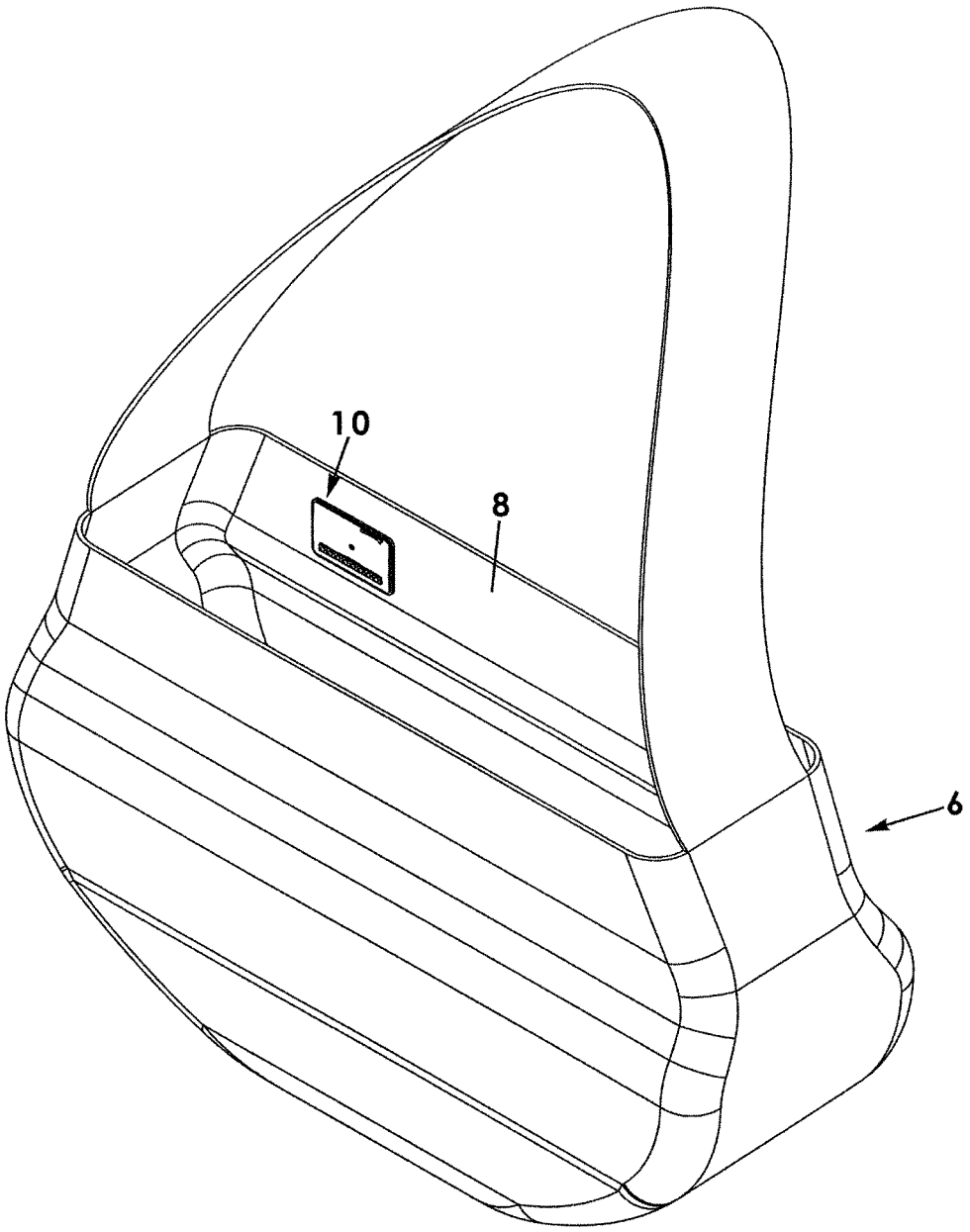
FIG. 4 is a perspective view of a purse lighting device according to another embodiment of the present invention illustrated coupled to a purse.
Figure 5:
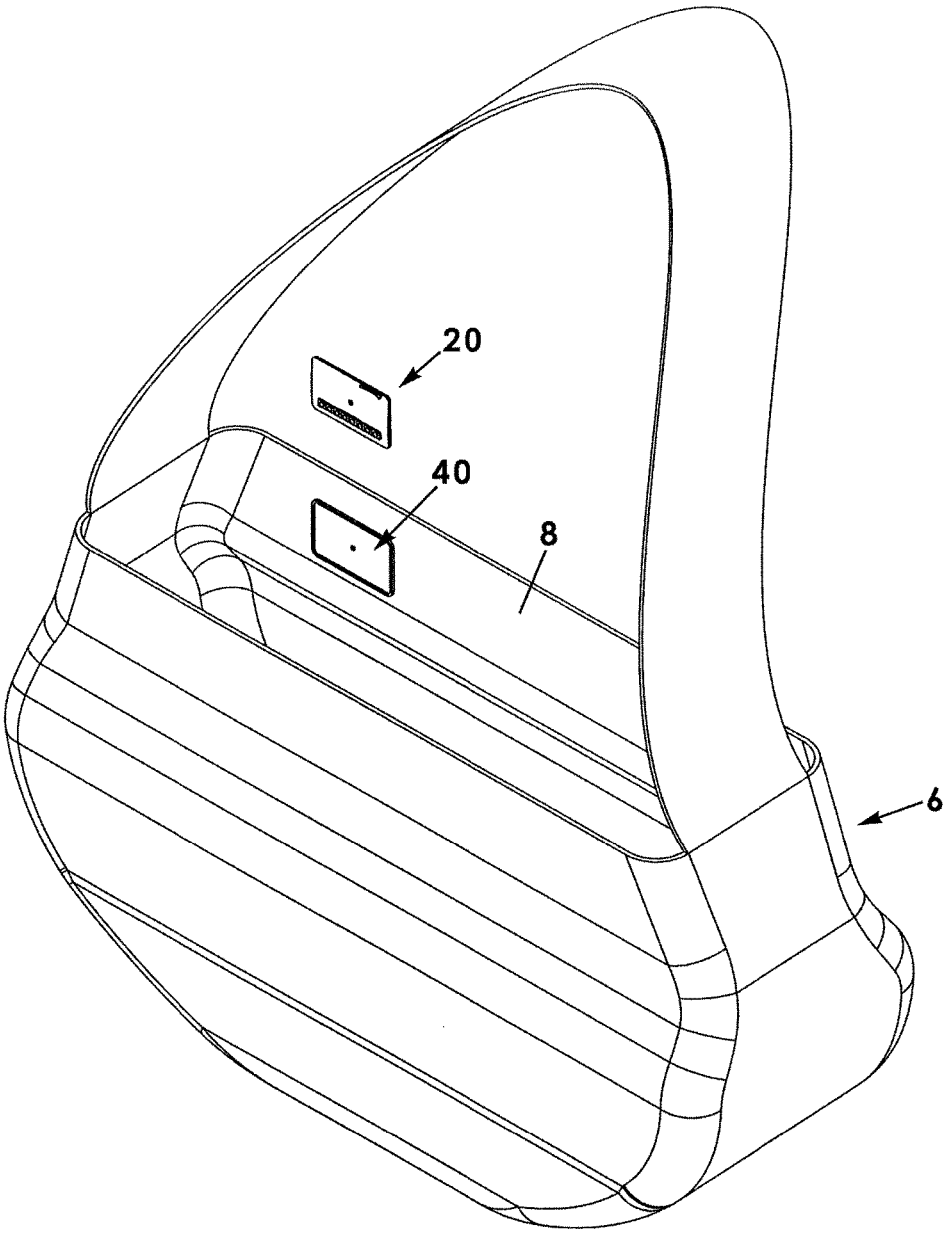
FIG. 5 is a perspective view of a purse lighting device as in FIG. 4 partially removed from the purse.

In an embodiment, a light element 36 is coupled to the front side 22 of the front panel 20 and is electrically connected to the circuit board 26. Preferably, the light element 36 is a plurality of lighting elements situated adjacent one another, such as a light bank (FIG. 3). Each light element 36 is a light emitting diode ("LED"). Light emitting diodes are advantageous in that they require minimal electrical current, can operate for an extended length of time without replacement, and provide excellent light output.

Figure 6A:
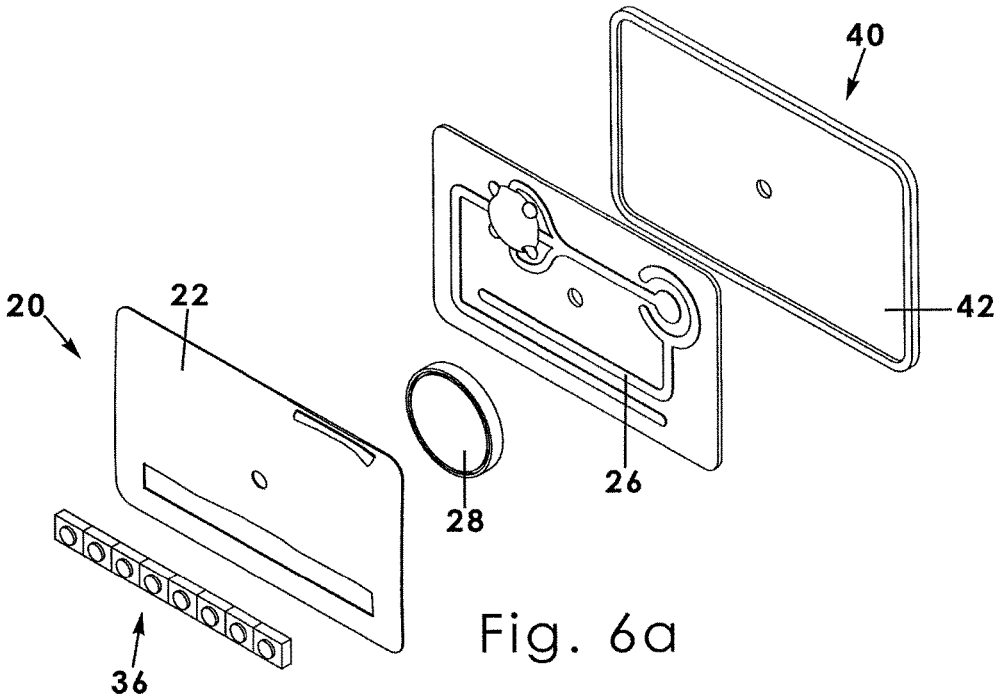
FIG. 6*a* is an exploded view of the purse lighting device as in FIG. 6 from a front angle.
Figure 6B:
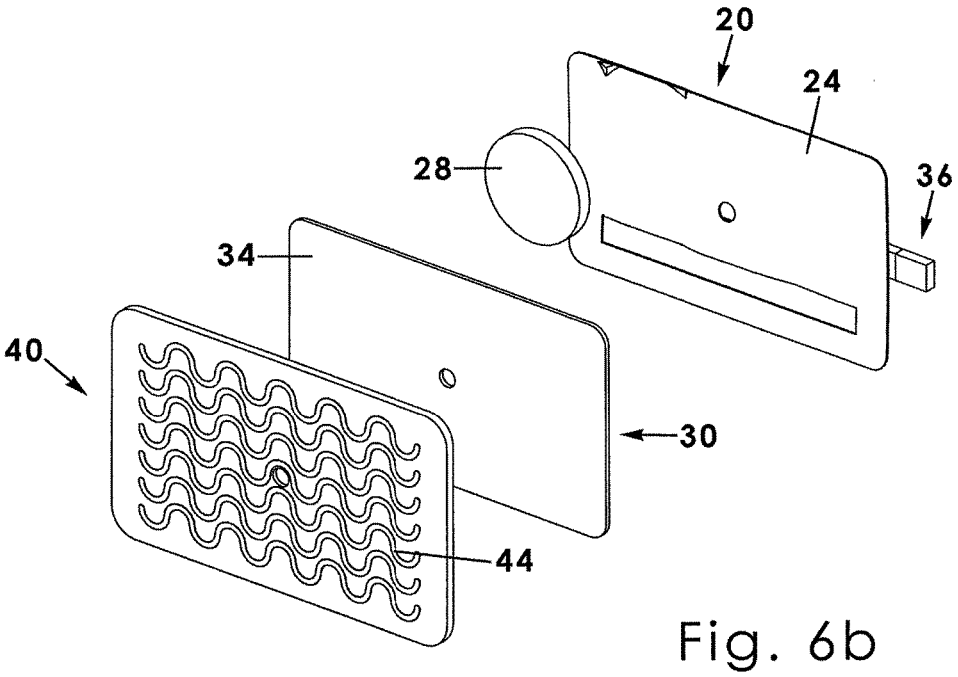
FIG. 6*b* is an exploded view of the purse lighting device as in FIG. 6 from a rear angle.

The purse lighting device 10 is configured for attachment to the inner wall 8 of the purse 6 so as to selectively illuminate the interior area of the purse 6. In an embodiment, a mounting member 40 includes an inner side 42 and an outer side 44. The inner side 42 has a magnetic surface (FIG. 6*a*) while the outer side 44 includes an adhesive surface (FIG. 6*b*). The adhesive surface may be selectively coupled to the inner wall 8 of the purse 6 (FIGS. 1*a* and 5*a*). In this embodiment, the back side 34 of the back panel 30 may include a magnetic surface complementary to that on the inner side of mounting member 40. Therefore, the mounting member 40 may be attached to the purse 6 and the purse lighting device 10 may be attached to the mounting member 40.

Figure 1B:
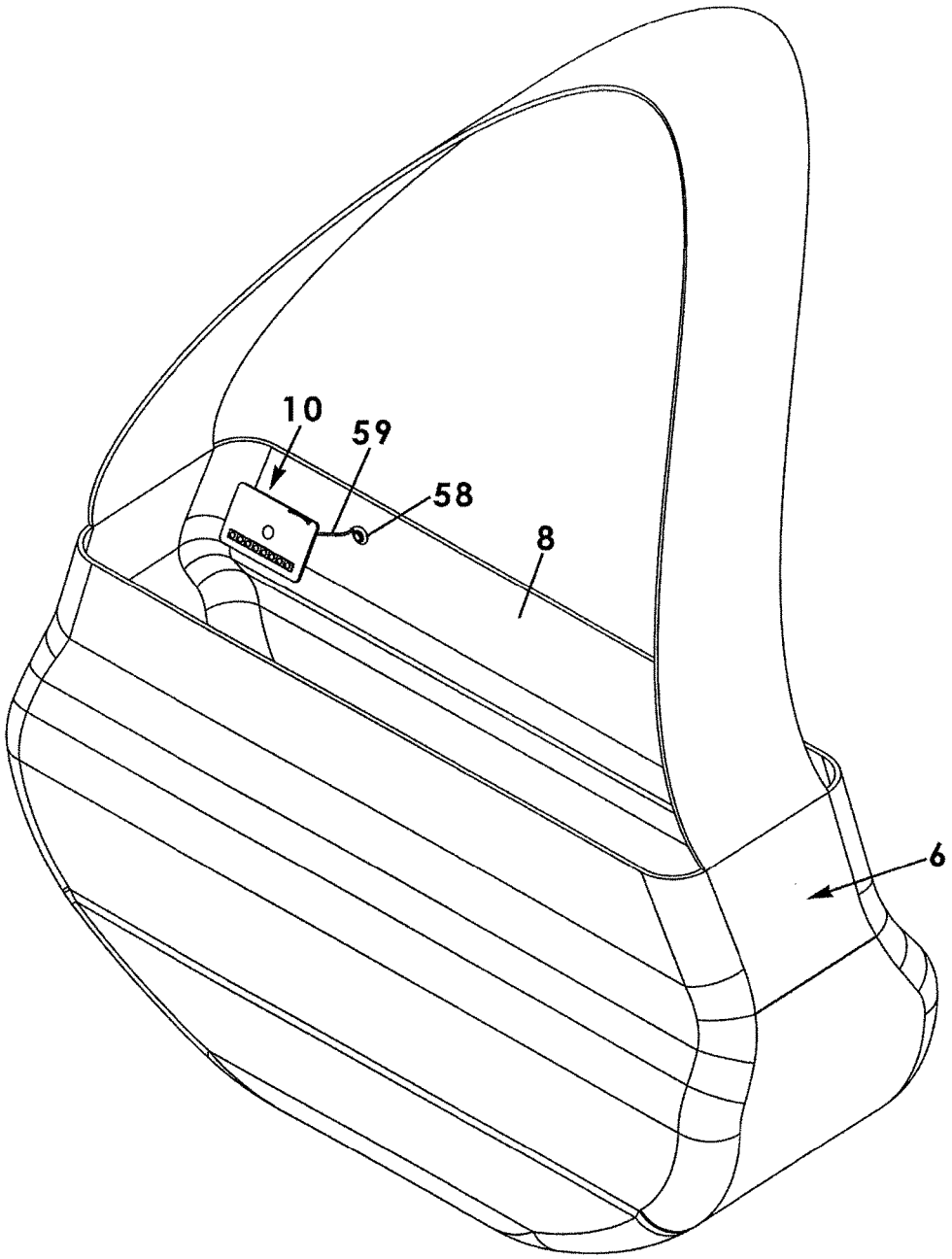
FIG. 1*b* is a perspective view of a purse lighting device as in FIG. 1 illustrated in an extended configuration relative to the purse.
Figure 1C:
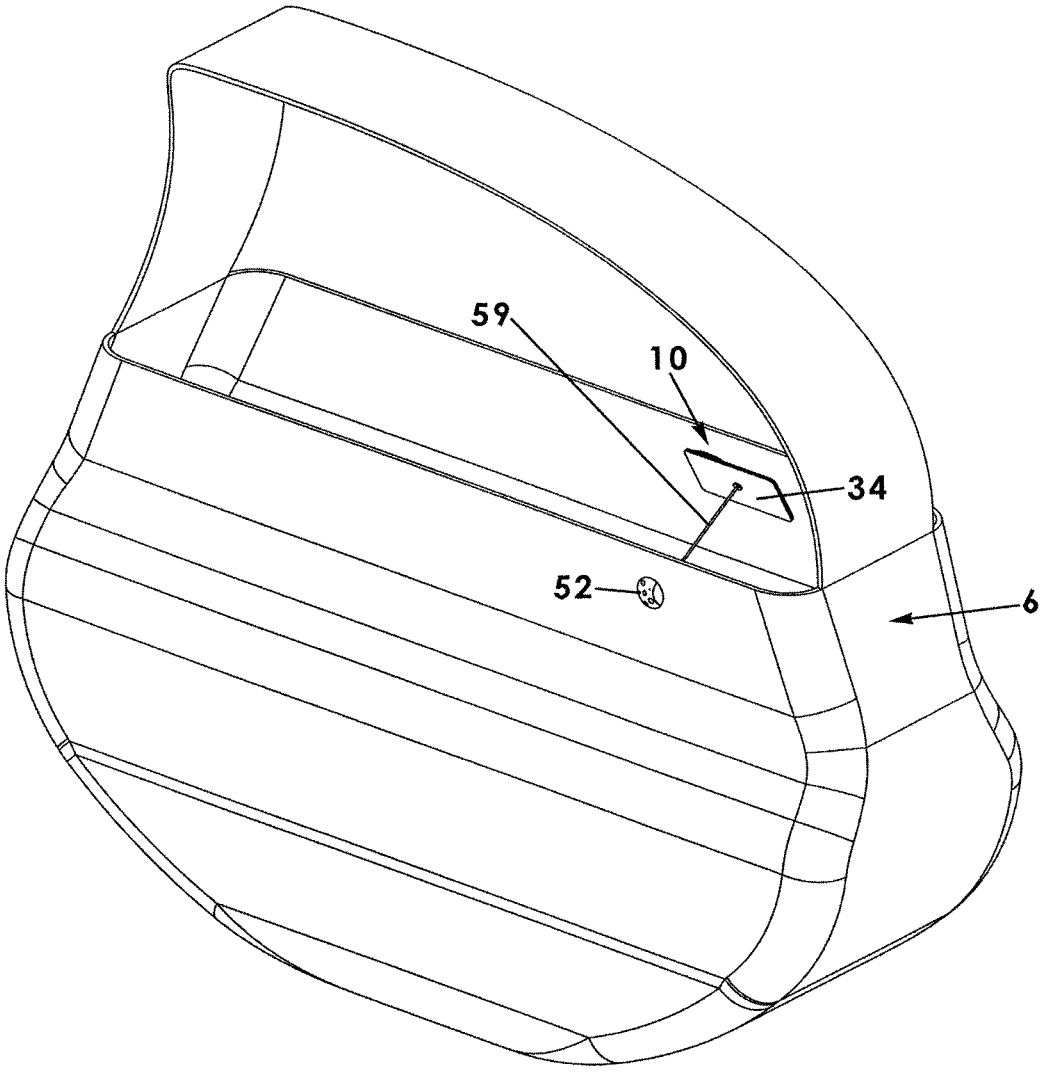
FIG. 1*c* is a perspective view of the lighting device as in FIG. 2 taken from another angle.
Figure 2:
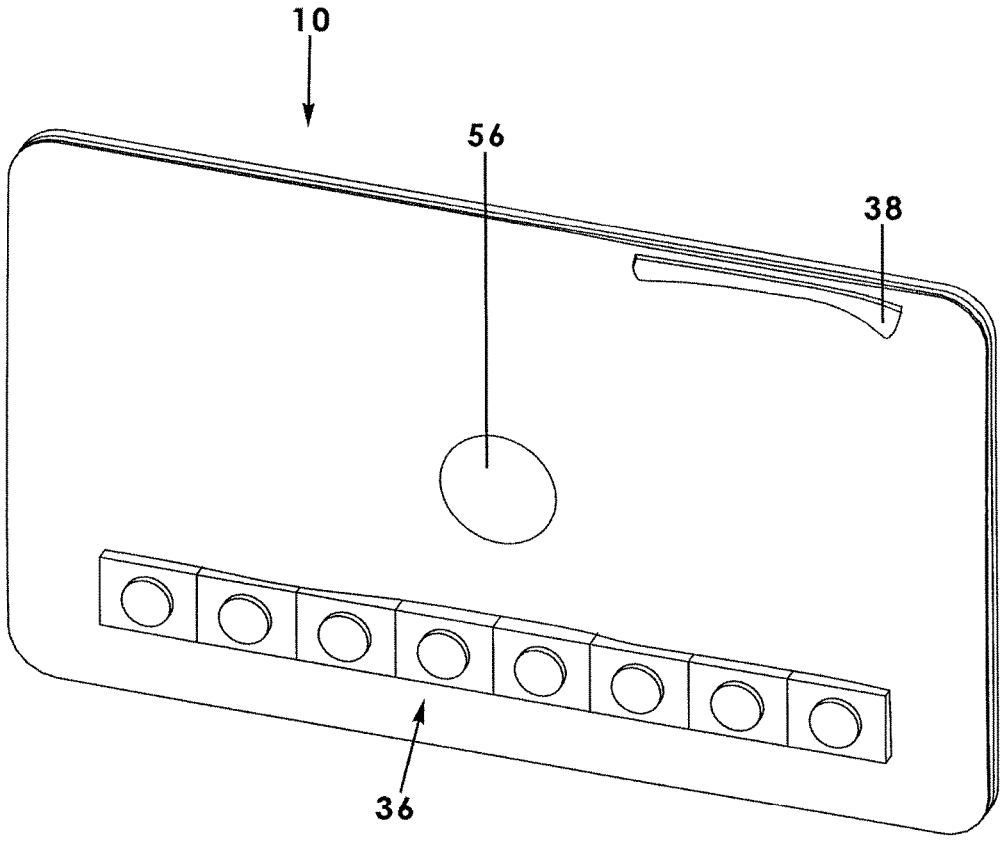
FIG. 2 is a perspective view of the purse lighting device as in FIG. 1 removed from the purse.

In another embodiment, the purse lighting device 10 may be attached to the purse 6 using a pin and button arrangement (FIGS. 1*b* and 1*c*). More particularly, a mounting device 50 includes a first portion 52 situated adjacent the back side 34 of the back panel 30 and a pin 54 extending away from the first portion 52 and through the back panel 30 and front panel 20 (FIG. 3). The mounting device 50 also includes a cover 56 releasably coupled to a free end of the pin 54 of the first portion 52. In use, the pin 54 may be passed through the inner wall 8 of the purse 6 and then through the back and front panels so as to hold the panels to the inner wall 8.

In this embodiment, the purse lighting device 10 may include a spring reel 58 with a cord 59 housed therein, the cord 59 being movable between a retracted configuration substantially within the housing of the spring reel 58 and extended configurations substantially outside the housing of the spring reel 58. Specifically, the spring reel 58 may be spring biased to normally urge the cord toward the retracted configuration. Preferably, the spring reel 58 is coupled to an inward side of the first portion 52 of the mounting device 50 (FIG. 3). A free end of the cord 59 is coupled to the back side 34 of the back panel 30. In use, the spring reel 58 and cord 59 enables the lighting device 10 to be manually extended away from the interior wall 8 to which it is coupled, such as to focus the light down into the interior of the purse or toward a key hole or the like. The lighting device 10 then automatically retracts back toward the interior wall 8 when a manual pulling force is released.

The front side 22 of the front panel 20 may define a slot 38 in operative communication with an interior space between the front panel 20 and back panel 30. The slot 38 is configured to receive a battery 28 into the interior space such that the battery 28 may be electrically connected to the circuit board 26. When the battery 28 is in place, the circuit board 26 may be energized to deliver current to the light member 36. The circuit board 26 may be configured to provide current to the light element 36 for a predetermined amount of time.

In use, the purse lighting device 10 is first mounted to an inner wall 8 of the purse 6, such as with adhesive or with a fastener as described above. Then, when it is desired to illuminate an interior area of the purse 6, the light element 36 may be energized as described. If a user desires to completely remove the purse lighting device 10, such as to use the lighting element to illuminate a door lock, a car interior, or a ground surface (such as if an item was dropped), then either the lighting device 10 may be detached from the magnetic mounting member 40 or by removing the cover 56 from the mounting device 50, as described above.

It is understood that while certain forms of this invention have been illustrated and described, it is not limited thereto except insofar as such limitations are included in the following claims and allowable functional equivalents thereof.

The invention claimed is:

1. A purse lighting device for use with a purse having an inner wall defining an interior area, said purse lighting device comprising:

a front panel having a front side and a back side opposite said front side, said front panel having a generally planar configuration;

a back panel having a front side and a back side opposite said front side, said back panel having a generally planar configuration;

wherein said back side of said front panel is operably coupled to said front side of said back panel;

wherein said front side of said back panel includes a circuit board;

a battery electrically coupled to said circuit board;

a light element situated on said front side of said front panel and electrically coupled to said battery such that said light element is selectively energized by said battery;

wherein said back side of said back panel is operatively coupled to the inner wall of the purse wherein the interior area of the purse is illuminated when said light element is energized;

a mounting member having an inner side and an opposed outer side;

wherein:

said outer side of said mounting member has an adhesive surface that is selectively attached to the inner wall of the purse;

said inner side of said mounting member has a magnetic surface; and said back side of said back panel includes a magnetic surface releasably coupled to said inner side of said mounting member.

2. A purse lighting device for use with a purse having an inner wall defining an interior area, said purse lighting device comprising:

a front panel having a front side and a back side opposite said front side, said front panel having a generally planar configuration;

a back panel having a front side and a back side opposite said front side, said back panel having a generally planar configuration;

wherein said back side of said front panel is operably coupled to said front side of said back panel;

wherein said front side of said back panel includes a circuit board;

a battery electrically coupled to said circuit board;

a light element situated on said front side of said front panel and electrically coupled to said battery such that said light element is selectively energized by said battery;

wherein said back side of said back panel is operatively coupled to the inner wall of the purse wherein the interior area of the purse is illuminated when said light element is energized;

a mounting device having a first portion situated adjacent said back side of said back panel and a pin extending away from said first portion through said back panel and said front panel;

a cover releasably coupled to an end of said pin, said mounting device and said cover being operative to selectively attach said front and back panels to the inner wall of the purse.

3. The purse lighting device as in claim 1, wherein said light element is a light emitting diodes.

4. The purse lighting device as in claim 1, wherein said light element is a plurality of light elements situated adjacent one another.

5. The purse lighting device as in claim 1, wherein each said light element is a light emitting diode.

6. The purse lighting device as in claim 1, wherein said light element is a plurality of light elements situated adjacent one another.

7. The purse lighting device as in claim 6, wherein each said light element is a light emitting diode.

8. The purse lighting device as in claim 2, wherein said light element is a plurality of light elements situated adjacent one another.

9. The purse lighting device as in claim 8, wherein each said light element is a light emitting diode.

10. The purse lighting device as in claim 2, wherein said mounting device includes:

a spring reel having a housing;

a cord having a free end coupled to said back panel, said cord being movable between a retracted configuration substantially inside said housing and an extended configuration substantially outside said housing.

11. The purse lighting device as in claim 10, wherein said cord is spring biased to move normally toward said retracted configuration.

12. The purse lighting device as in claim 8, wherein said mounting device includes:

a spring reel having a housing;

a cord having a free end coupled to said back panel, said cord being movable between a retracted configuration substantially inside said housing and an extended configuration substantially outside said housing.

13. The purse lighting device as in claim 1, wherein said front panel defines a slot in operative communication with a space between said front panel and said back panel, said slot being configured to selectively receive said battery into a space between said front panel and said back panel and in electrical communication with said circuit board such that said circuit board is energized to deliver current to said light element.

14. The purse lighting device as in claim 2, wherein said front panel defines a slot in operative communication with a space between said front panel and said back panel, said slot being configured to selectively receive said battery into a space between said front panel and said back panel and in electrical communication with said circuit board such that said circuit board is energized to deliver current to said light element.

* * * * *